US007055343B2

(12) United States Patent
Crova

(10) Patent No.: US 7,055,343 B2
(45) Date of Patent: Jun. 6, 2006

(54) JEWELRY CHAIN

(75) Inventor: Francesca Crova, Alessandria (IT)

(73) Assignee: Louis Vuitton Malletier, Paris (FR)

( * ) Notice: Subject to any disclaimer, the term of this patent is extended or adjusted under 35 U.S.C. 154(b) by 17 days.

(21) Appl. No.: 10/471,371

(22) PCT Filed: Mar. 8, 2002

(86) PCT No.: PCT/FR02/00839

§ 371 (c)(1),
(2), (4) Date: Oct. 8, 2003

(87) PCT Pub. No.: WO02/071885

PCT Pub. Date: Sep. 19, 2002

(65) Prior Publication Data

US 2004/0079109 A1 Apr. 29, 2004

(30) Foreign Application Priority Data

Mar. 12, 2001 (FR) ..... 01 03317

(51) Int. Cl.
*A44C 5/10* (2006.01)
*A44C 5/02* (2006.01)

(52) U.S. Cl. ..... 63/4; 63/3; 59/84

(58) Field of Classification Search ..... 63/3–11, 63/37–39; 59/78, 80, 82, 85; D11/13
See application file for complete search history.

(56) References Cited

U.S. PATENT DOCUMENTS 282,280 A * 7/1883 Davidson ..... 63/3
365,115 A * 6/1887 Bigney ..... 63/3
1,787,405 A * 12/1930 Dansereau ..... 59/80

(Continued)

FOREIGN PATENT DOCUMENTS

CH 665-100 A * 4/1988 ..... 63/3

(Continued)

OTHER PUBLICATIONS

French Search Report, Appl. FR/0103317 dated Dec. 3, 2001.

(Continued)

*Primary Examiner*—Robert J. Sandy
*Assistant Examiner*—Ruth C. Rodriguez
(74) *Attorney, Agent, or Firm*—McCracken & Frank LLP

(57) ABSTRACT

A jewelry chain comprising links which are articulated in twos. The chain consists of first links each comprising two semi-links which are interassembled by means of welding and/or soldering, the first links each extending essentially according to a plane (X, Y) and being pivotably linked to adjacent links by means of pivots all of which are parallel to the respective planes (X, Y) of the first links. The chain also comprises second links which are alternatingly disposed with first links, each of the second links forming a continuous ring extending essentially according to a plane which is perpendicular to the adjacent first links.

12 Claims, 2 Drawing Sheets

U.S. PATENT DOCUMENTS

| | | | | | |
|---|---|---|---|---|---|
| 1,997,723 | A | * | 4/1935 | Franklin, Jr. | 63/5.1 |
| 1,997,724 | A | * | 4/1935 | Franklin, Jr. | 63/5.1 |
| 2,425,477 | A | * | 8/1947 | Larson | 63/3 |
| 2,588,655 | A | * | 3/1952 | O'Neill | 24/71 J |
| 4,000,627 | A | | 1/1977 | Wahlbeck | 63/2 |
| 4,170,871 | A | * | 10/1979 | Vanover et al. | 59/82 |

FOREIGN PATENT DOCUMENTS

| | | | | |
|---|---|---|---|---|
| DE | 2 203 277 | | 8/1973 | |
| DE | 87 10 625 | | 10/1987 | |
| DE | 94 16 952 | | 2/1995 | |
| EP | 0 313 711 | | 5/1989 | 5/10 |
| FR | 2495-449 | * | 6/1982 | 63/4 |
| FR | 2640124 | | 6/1990 | |
| FR | 2693355 | | 1/1994 | 5/10 |
| WO | WO 97/22275 | | 6/1997 | |

OTHER PUBLICATIONS

International Search Report dated Jul. 17, 2002, International Application No. PCT/FR 02/00839.

* cited by examiner

JEWELRY CHAIN

FIELD OF THE INVENTION

The present invention relates to jewelry chains.

More particularly, the invention relates to a jewelry chain including links articulated in twos, this chain including first links that each comprise two interassembled semi-links, these first links each extending substantially in a plane and being pivotably linked to the adjacent links by means of pivots that are all parallel to the respective planes of said first links.

BACKGROUND OF THE INVENTION

Document EP-A-0 313 711 describes an example of a jewelry chain of this type, which includes only first links. The two semi-links of each of these first links are interassembled by means of simple mutual nesting of two grooves made respectively in these semi-links, the semi-links being prevented from disconnecting from one another by virtue of their play-free mounting on pins that are all parallel and that link the links together.

This type of mounting presents the drawback of being incompatible with a chain in which the adjacent links are perpendicular in twos, which is desired in certain cases.

Moreover, the mounting in question may sometimes be weak, insofaras the chain holds together only by virtue of the play-free engagement of the pins in the semi-links.

Lastly, this chain of the prior art does not make it possible to allow a relative movement between the links other than the pivoting about pins that are completely parallel to one another: in point of fact, a certain degree of freedom of movement may sometimes be desirable.

OBJECTS OF THE INVENTION

An object of the present invention is therefore, in particular, to offset these drawbacks and to propose a jewelry chain:

- in which the adjacent links may, if appropriate, be perpendicular in twos, advantageously by forming rings of substantially identical sizes that are engaged in one another while leaving an empty space in the center of each ring;
- that preferably has greater mechanical strength than the above-mentioned prior-art chains;
- and that may, if appropriate, have a certain freedom of movement in a number of axes of rotation between adjacent links.

To this end, according to the invention, a jewelry chain of the type in question is characterized in that it also includes second links that are different from the first links and arranged so as to alternate with said first links, each of the second links forming a continuous ring (it being possible for this continuity, if appropriate, to be obtained by welding or soldering of several pieces together) and extending substantially in a plane, the respective planes of these second links being substantially perpendicular to the planes of the adjacent first links, and the semi-links of each first link being interassembled by means of welding and/or soldering, thereby forming a continuous ring of material.

By virtue of these arrangements, a jewelry chain is obtained:

- in which the links are kept substantially perpendicular in twos, it being possible for these links, if appropriate, to all be substantially identical and engaged in one another while leaving a free space in the centre of said links;
- that has great strength because the first and second links each form a continuous ring of material;
- and that allows, if appropriate, play between the links outside of the simple pivoting about pivots, which then makes it possible to obtain greater flexibility for the chain.

In the preferred embodiments of the invention, it is possible, if appropriate, to have recourse moreover to one and/or another of the following arrangements:

- the second links each include two through-holes pierced perpendicularly to the planes of said second links, and the first links each include two pins, which are parallel to one another and parallel to the planes of said first links, the first and second links being articulated in twos by engagement of the pins of the first links in the through-holes of the second links;
- the pins of each first link are each fitted into two blind holes opening out toward the inside of said first link and made, respectively, in each of the two semi-links forming said first link;
- each pin of a first link is secured by welding or soldering to the two semi-links forming said first link;
- each first link includes two notches that open toward the inside of the first link and are each traversed by one of the pins of said first link, each of these notches being made partly in one of the semi-link forming said first link and partly in the other semi-link forming said first links;
- the semi-links forming each first link are in mutual contact via two end faces at each of the two notches of said first link;
- said end faces interact by means of mutual nesting such that each first link includes a portion passing to the inside of an adjacent second link;
- said end faces are welded together;
- the through-holes of each second link have flared ends;
- the flared ends of the through-holes of each second link open out respectively in grooves made in said second links, these grooves extending in a direction substantially perpendicular to the portion of said second link in which they are made;
- the links are articulated together with sufficient play to allow angular clearances of between 5 and 30 degrees of each link relative to an adjacent link along three axes that are perpendicular in twos;
- said angular clearances are between 10 and 20 degrees;
- the first and second links all have annular forms, each link including a hollow inner space that has dimensions, measured in two perpendicular directions belonging to the plane of said link, that are twice as large as a thickness of one link, said links penetrating respectively in the hollow inner spaces of the adjacent links.

BRIEF DESCRIPTION OF THE DRAWINGS

Further characteristics and advantages of the invention will become apparent during the following description of one of its embodiments that is given by way of non-limiting example; with respect to the attached drawings.

In the drawings.

DETAILED DESCRIPTION OF THE DRAWINGS

Figure 1:
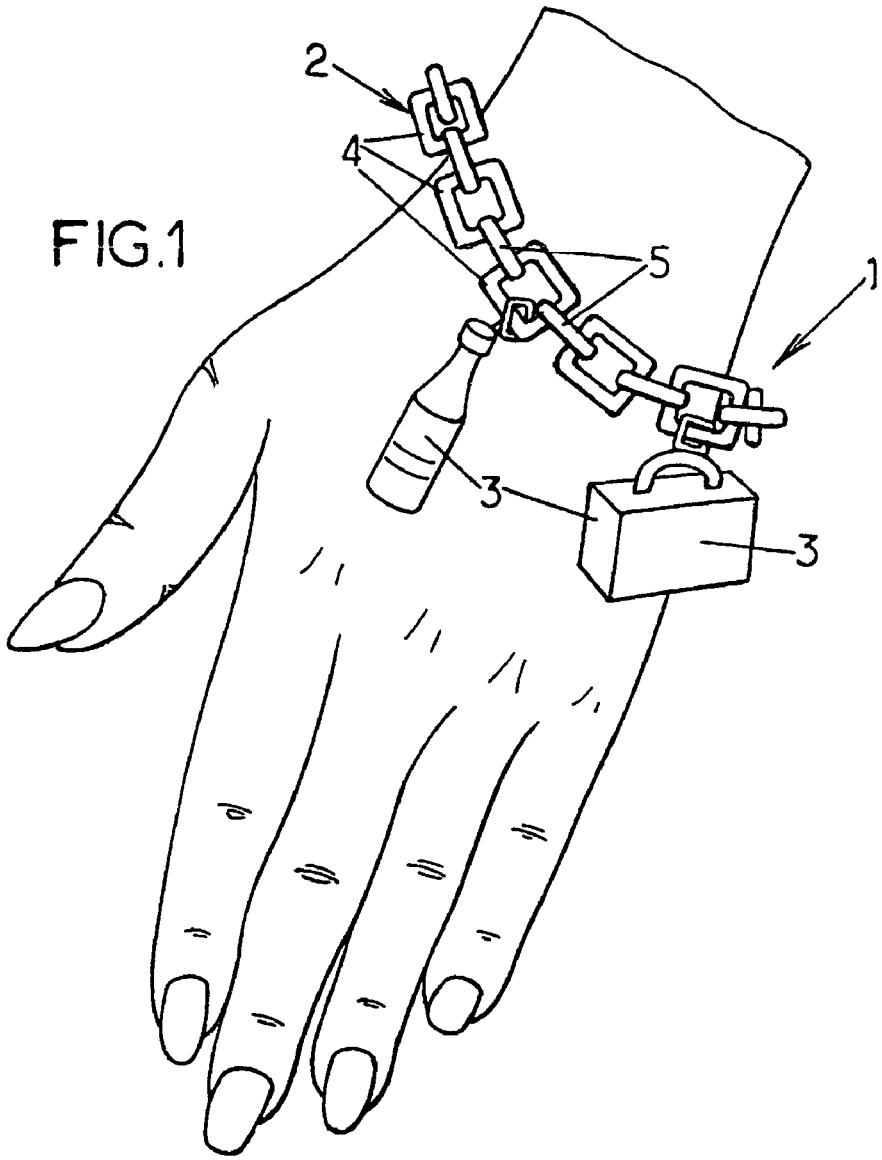
FIG. 1 is a diagrammatic view of a bracelet including a chain according to one embodiment of the invention.

In the various figures, the same reference numerals denote identical or similar elements.

FIG. 1 shows a bracelet 1 comprising a chain 2 according to one embodiment of the invention, which, in the example shown, carries charms 3.

Figure 2:
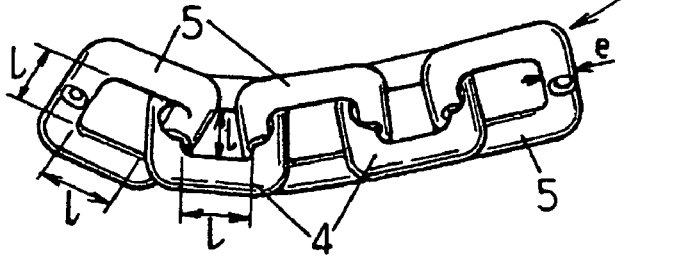
FIG. 2 is an enlarged perspective view of the chain belonging to the bracelet of FIG. 1.

As shown in FIG. 2, the chain 2 is formed by alternating first and second metal links 4, 5 in the shape of rings that are articulated in twos and substantially perpendicular in twos. These links 4, 5 are in this case all of identical general shape—substantially square with rounded corners—and they interpenetrate while leaving a free space in the center of each link. This free space is preferably of a size greater than the thickness of the links. More generally, the hollow space at the center of each link 4, 5 has dimensions 1 greater than the thickness e of a link, in two mutually perpendicular directions included in the plane of said link. In the example shown in the drawings, the dimensions 1 of the hollow space are identical in both directions X, Y or Y, Z of the link 4, 5 in question (see FIGS. 3 and 5), but, if appropriate, the situation could be different. Similarly, the thickness e of each link 4, 5 is in this case identical whether measured in the plane of said link or perpendicularly to that plane, but, if appropriate, the situation could be different.

Figure 3:
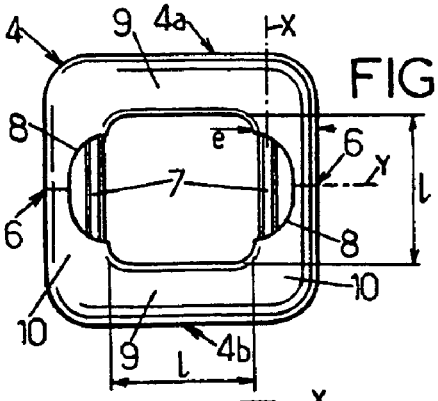
FIG. 3 is a view in detail of a first link of the chain in FIG. 2.

The first links 4, one of which is shown in FIG. 3, are formed from two semi-links 4*a*, 4*b* each extending in a plane X, Y, in which X and Y are two perpendicular axes that are parallel respectively to the sides 9, 10 of the link 4.

At the junctions 6 between the two semi-links 4*a*, 4*b*, on two opposite sides 10 of the link 4, this link forms notches 8 that are open toward the inside of said link. Each of these notches 8 is traversed by a metal pin 7 that is parallel to the longitudinal axis X of the corresponding side 10 of the link and serves as axis of rotation between the links 4, 5.

Figure 4:
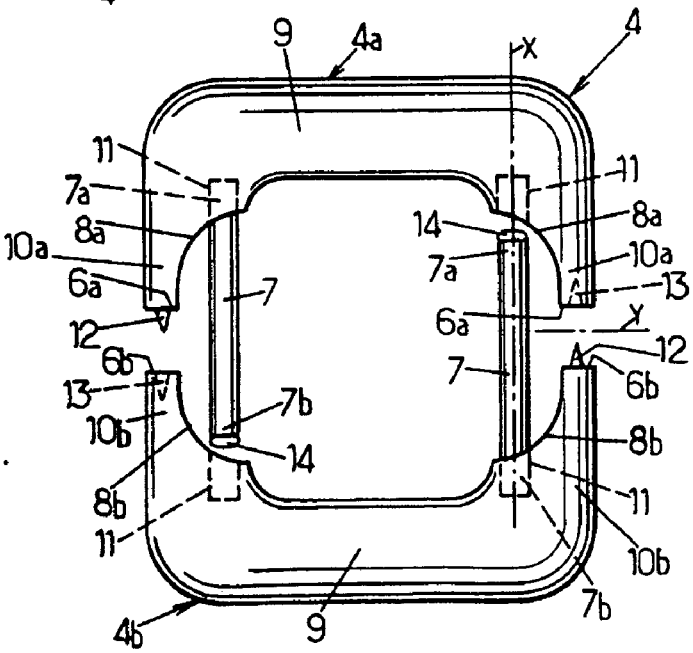
FIG. 4 is a view illustrating the way in which the first link in FIG. 3 is manufactured.

As may be seen in greater detail in FIG. 4, each of the two semi-links 4*a*, 4*b* thus forms two complete opposite sides 9 of the link 4 and two opposite half-sides, 10*a* in the case of the semi-link 4*a* and 10*b* in the case of the semi-link 4*b* respectively.

The half-sides 10*a*, 10*b* of the semi-links respectively form two halves 8*a*, 8*b* of each of the notches 8 and extend one toward the other as far as opposite end faces 6*a*, 6*b* that form the above-mentioned junctions 6 when the semi-links are assembled.

Furthermore, each of the semi-links 4*a*, 4*b* includes two blind holes 11 that are open towards the inside of the link and in which the ends 7*a*, 7*b* of the pins 7 are nested.

Prior to mounting of the links 4, one of the ends of each pin 7 is nested and welded in the corresponding blind hole 11 of one of the two semi-links 4*a*, 4*b*, while a drop of solder 14 is deposited in the molten state, and then solidified on the opposite end of each pin (in the example shown in FIG. 4, each semi-link 4*a*, 4*b* is thus assembled on one of the pins 7 of the corresponding link, but, naturally, the two pins 7 could therefore be assembled in advance on the same semi-link).

Next, when mounting the chain 2, the semi-links 4*a*, 4*b* of the links 4 are assembled by nesting (preferably forcibly) the ends of the pins 7 provided with drops of solder 14 in the corresponding blind holes 11, while engaging said pins 7 in the second links 5, as will be explained below.

The chain 2 thus produced is then heated to above the melting point of the drops of solder 14, which then melt. Thus, after cooling, the semi-links 4*a*, 4*b* forming the first links 4 are assembled together by welding and soldering (if appropriate, assembly could be achieved by soldering at both ends of the pins 7), such that the first links 4 each form a ring of continuous material and have excellent mechanical strength.

Advantageously, some of the end faces 6*a*, 6*b* of the half-sides 10*a*, 10*b* may be provided with spikes 12 and the others with blind holes 13 receiving the spikes 12 by nesting during assembly of the semi-links 4*a*, 4*b*. This nesting has the effect, on the one hand, of promoting proper positioning of the semi-links and, on the other, of increasing still further the mechanical strength of the link 4.

If appropriate, it would also be possible to weld the end faces 6*a*, 6*b* after assembly of the semi-links. If appropriate, this welding could even replace the welding and/or soldering of the ends of the pins 7.

Figure 5:
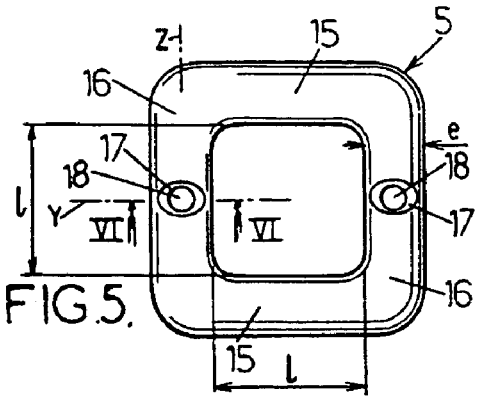
FIG. 5 is a view in detail of a second link of the chain in FIG. 2.

Furthermore, as shown in FIG. 5, each second link 5 of the chain 2 extends substantially in a plane Y, Z (Z being an axis perpendicular to the axes X and Y mentioned above), and has two opposite sides 15 extending along the axis Y parallel to the sides 9 of the first links 4, and two opposite sides 16 extending along the axis Z substantially perpendicularly to the longitudinal axis X of the sides 10 of the first links.

Each of the sides 16 of the second links 5 includes, substantially at its center, two reinforcements 17 in the form of grooves substantially parallel to the axis Y, the grooves 17 of each side 16 being arranged substantially symmetrically relative to the median plane Y, Z of the second link 5. A through-hole 18 is made in the center of each of these grooves, parallel to the axis X.

Figure 6:
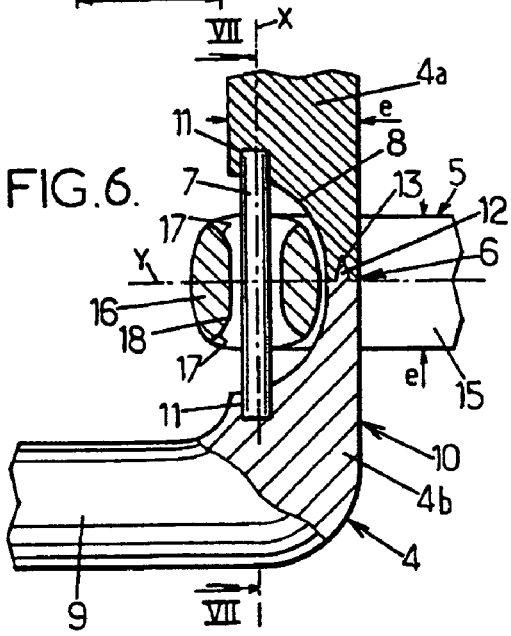
FIG. 6 is a partial view in section of the chain in FIG. 2, the section being taken on VI—VI of FIG. 5.
Figure 7:
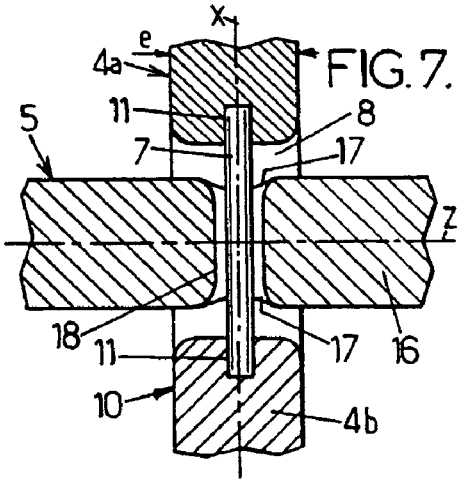
FIG. 7 is a partial view in section on VII—VII of FIG. 6.

As may be seen in greater detail in FIGS. 6 and 7, each hole 18 receives, with play, one of the pins 7 of an adjacent first link 4. Furthermore, the hole 18 advantageously has a double divergent form, flaring from the median part of the hole 18 as far as the ends of that hole, which open out in the grooves 17. Lastly, each side 16 of the second links 5 is received with play in the corresponding notch 8 of the corresponding first link 4.

By virtue of these arrangements, each second link 5 can not only pivot about the axis X of each pin 7 on which it is engaged, but also pivot with limited clearance (for example 5 to 30 degrees, advantageously 10 to 20 degrees) about the axes Y and Z relative to the adjacent first links 4.

The invention claimed is:

1. A jewelry chain including links articulated in twos, this chain including first links that each comprise two interassembled open semi-links, these first links each extending substantially in a plane and being pivotably linked to the adjacent links by means of pivots that are all parallel to the respective planes of said first links, wherein said jewelry chain also includes second links that are different from the first links and arranged so as to alternate with said first links, each of the second links forming a continuous ring and extending substantially in a plane, the respective planes of these second links being substantially perpendicular to the planes of the first adjacent links, and the semi-links of each first link being interassembled by means of welding and/or soldering, thereby forming a continuous ring of material, wherein the second links each include two through-holes pierced perpendicularly to the planes of said second links, and the first links each include two pins forming said pivots, which are parallel to one another and parallel to the planes of said first links, the first and second links being articulated in twos by engagement of the pins of the first links in the through-holes of the second links.

2. The chain as claimed in claim 1, wherein the pins of each first link are each fitted into two blind holes opening out toward the inside of said first link and made, respectively, in each of the two semi-links forming said first link.

3. The chain as claimed in claim 1, wherein each pin of a first link is secured by welding or soldering to the two semi-links forming said first link.

4. The chain as claimed in any one of claim 1, wherein each first link includes two notches that open toward the inside of the first link and are each traversed by one of the pins of said first link, each of these notches being made partly in one of the semi-link forming said first link and partly in the other semi-link forming said first links.

5. The chain as claimed in claim 4, wherein the semi-links forming each first link are in mutual contact via two end faces at each of the two notches of said first link, such that each first link includes a portion passing to the inside of an adjacent second link.

6. The chain as claimed in claim 5, wherein said end faces interact by means of mutual nesting.

7. The chain as claimed in claim 5, wherein said end faces are welded together.

8. The chain as claimed in claim 1, in which the through-holes of each second link have flared ends.

9. The chain as claimed in claim 8, wherein the flared ends of the through-holes of each second link open out respectively in grooves made in said second links, these grooves extending in a direction substantially perpendicular to the portion of said second link in which they are made.

10. The chain as claimed in claim 1, wherein the links are articulated together with sufficient play to allow angular clearances of between 5 and 30 degrees of each link relative to an adjacent link along three axes that are perpendicular in twos.

11. The chain as claimed in claim 10, wherein said angular clearances are between 10 and 20 degrees.

12. The chain as claimed in claim 1, wherein the first and second links all have annular forms, each link including a hollow inner space that has dimensions, measured in two perpendicular directions belonging to the plane of said link, that are twice as large as a thickness of one link, said links penetrating respectively in the hollow inner spaces of the adjacent links.

* * * * *